US009204699B2

(12) United States Patent
Pickens et al.

(10) Patent No.: US 9,204,699 B2
(45) Date of Patent: Dec. 8, 2015

(54) ROLLER BAG HANDLE WITH LIGHTING

(71) Applicant: Custom LeatherCraft Manufacturing Co., Inc., South Gate, CA (US)

(72) Inventors: Ron A. Pickens, Owasso, OK (US); Matthew D. Noble, Los Angeles, CA (US)

(73) Assignee: Custom Leathercraft Manuf, Co., Inc., South Gate, GA (US)

( * ) Notice: Subject to any disclaimer, the term of this patent is extended or adjusted under 35 U.S.C. 154(b) by 0 days.

(21) Appl. No.: 14/266,968

(22) Filed: May 1, 2014

(65) Prior Publication Data

US 2014/0326562 A1 Nov. 6, 2014

Related U.S. Application Data

(60) Provisional application No. 61/818,710, filed on May 2, 2013.

(51) Int. Cl.

| | |
|---|---|
| ***A45C 5/14*** | (2006.01) |
| ***A45C 13/00*** | (2006.01) |
| ***A45C 13/26*** | (2006.01) |
| ***A45C 13/28*** | (2006.01) |
| ***A45C 15/06*** | (2006.01) |

(52) U.S. Cl.

CPC ..... *A45C 13/001* (2013.01); *A45C 5/14* (2013.01); *A45C 13/262* (2013.01); *A45C 13/28* (2013.01); *A45C 15/06* (2013.01)

(58) Field of Classification Search

CPC ..... A45C 13/26; A45C 2013/265; A45C 2013/267; A45C 15/06; A45C 5/14; A45C 13/001; A45C 13/262; A45C 13/28; F21V 33/0004; F21V 33/0084

USPC ..... 16/113.1, 405, 429, 900, 903; 362/154, 362/156, 245; 190/18 A

See application file for complete search history.

(56) References Cited

U.S. PATENT DOCUMENTS

| | | | | |
|---|---|---|---|---|
| 1,451,408 | A * | 4/1923 | Schneider | 362/156 |
| 2,334,084 | A * | 11/1943 | Gold et al. | 362/156 |
| 3,998,476 | A * | 12/1976 | Kazmark, Sr. | 280/655 |
| 4,855,881 | A * | 8/1989 | Pence | 362/156 |
| 5,475,574 | A * | 12/1995 | Chien | 362/108 |
| 6,158,872 | A * | 12/2000 | Rodgers | 362/156 |
| 6,688,636 | B2 * | 2/2004 | Han | 280/655 |
| 6,773,137 | B2 * | 8/2004 | Chang | 362/156 |
| 8,382,309 | B1 * | 2/2013 | Johnston | 362/156 |
| 2002/0066164 | A1 * | 6/2002 | White | 16/436 |
| 2002/0105798 | A1 * | 8/2002 | Hill | 362/156 |
| 2003/0002276 | A1 * | 1/2003 | Chen | 362/109 |
| 2004/0079603 | A1 * | 4/2004 | Miller et al. | 190/18 A |
| 2004/0124054 | A1 * | 7/2004 | Lu | 190/115 |
| 2004/0154131 | A1 * | 8/2004 | Earley et al. | 16/406 |
| 2004/0238304 | A1 * | 12/2004 | Fisher | 190/115 |
| 2005/0047124 | A1 * | 3/2005 | Hsien | 362/188 |
| 2006/0130275 | A1 * | 6/2006 | Tong | 16/113.1 |
| 2006/0191103 | A1 * | 8/2006 | Wu | 16/113.1 |
| 2007/0103892 | A1 * | 5/2007 | McDaniel et al. | 362/119 |
| 2007/0187202 | A1 * | 8/2007 | Wu | 190/115 |
| 2010/0251517 | A1 * | 10/2010 | Lai | 16/113.1 |
| 2010/0313383 | A1 * | 12/2010 | Lai | 16/113.1 |
| 2014/0268784 | A1 * | 9/2014 | Chen et al. | 362/249.07 |

* cited by examiner

*Primary Examiner* — Sue A Weaver

(57) ABSTRACT

One embodiment includes an extendible handle having a lighting device. The extendible handle is connected to two or more pairs of connected telescoping arms. A pair of base arms is connected to the two or more pairs of connected telescoping arms. A storage container includes one or more rolling elements and is connected to the pair of base arms.

13 Claims, 8 Drawing Sheets

ROLLER BAG HANDLE WITH LIGHTING

CROSS-REFERENCE TO RELATED APPLICATIONS

This application claims the priority benefit of U.S. Provisional Patent Application Ser. No. 61/818,710, filed May 2, 2013, incorporated herein by reference in its entirety.

TECHNICAL FIELD

One or more embodiments relate generally to lighting sources, and in particular, rolling bags with extendible handles including a lighting source.

BACKGROUND

Many people use bags and luggage for holding items for organization and convenience, to carry the items from one place to another. In low light environments, it is difficult to navigate within the bag, or around the bag without use of a flashlight.

SUMMARY

One or more embodiments relate to rolling storage devices including extendible handles that provide lighting. In one embodiment, an apparatus includes an extendible handle having a lighting device. The extendible handle is connected to two or more pairs of connected telescoping arms. In one embodiment, a pair of base arms is connected to the two or more pairs of connected telescoping arms. A storage container includes one or more rolling elements and is connected to the pair of base arms.

One embodiment provides a rolling storage system. In one embodiment, the rolling storage system comprises an extendible handle coupled to two or more pairs of telescoping arms. In one embodiment, a lighting device is coupled to the extendible handle. In one embodiment, a pair of base arms is coupled to the two or more connected telescoping arms and one or more attaching elements. A bag is coupled to the one or more attaching elements. The bag including one or more rolling elements.

One embodiment provides an apparatus comprising an extendible handle coupled to two or more pairs of telescoping arms. In one embodiment, a lighting device is coupled to the extendible handle. A pair of base arms is coupled to the two or more connected telescoping arms and one or more attaching elements that are configured for coupling to a utility bag.

These and other features, aspects and advantages of the one or more embodiments will become understood with reference to the following description, appended claims and accompanying figures.

BRIEF DESCRIPTION OF THE DRAWINGS

The embodiments are illustrated by way of example, and not by way of limitation, in the Figures of the accompanying drawings and in which like reference numerals refer to similar elements and in which.

DETAILED DESCRIPTION

The following description is made for the purpose of illustrating the general principles of the one or more embodiments and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

The description may disclose several preferred embodiments for rolling bags with extendible handles that include a lighting source, as well as operation and/or component parts thereof. While the following description will be described in terms of rolling bags having extendible handles with a lighting source for clarity and to place the one or more embodiments in context, it should be kept in mind that the teachings herein may have broad application to all types of systems, devices and applications.

One embodiment of the invention provides an apparatus that includes an extendible handle having a lighting device. The extendible handle is connected to two or more pairs of connected telescoping arms. In one embodiment, a pair of base arms is connected to the two or more pairs of connected telescoping arms. A storage container includes one or more rolling elements and is connected to the pair of base arms.

Figure 1:
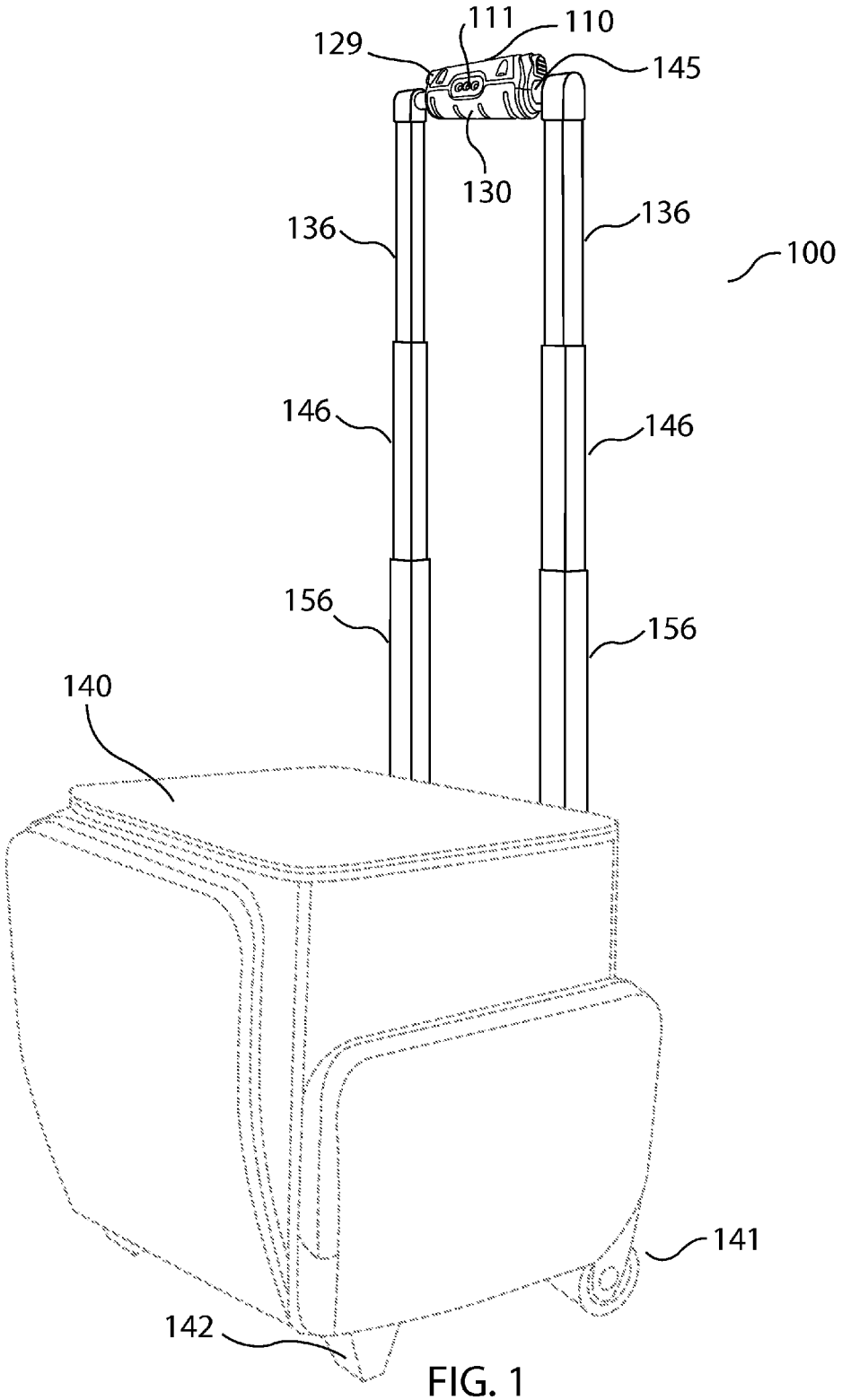
FIG. 1 a perspective view of a lighting device coupled to an extendible handle showing an example utility bag according to one embodiment.

FIG. 1 illustrates a system 100 comprising a lighting device 110 for an extendible handle 145 of a rolling device or utility bag 140 (e.g., an open/closed tool bag, accessory bag, fishing bag, duffel bag, sports bag, equipment bag, camping bag, emergency equipment bag, luggage, etc.) according to one embodiment. In one embodiment, the lighting device 110 includes a lighting source housing including an upper portion 129 and a lower portion 130 that are connected to swivel anchor devices that attach to the handle 145.

In one example embodiment, the lighting device 110 is attached to a handle 145 of a utility bag 140, where the handle 145 includes an extendible handle portions 136, 146 and 156 that are telescoping (i.e., that fit within one another and lock or remain in an extended state when the handle is extended, and that lock or collapse within one another when the handle is compressed or closed). In one embodiment, the lighting device 110 includes a lighting element 111. In one example, the lighting element 111 includes one or more light emitting diodes (LEDs), such as one, two, three, four, five, six, etc.

In one embodiment, the utility bag 140 comprises a hinged cover, flexible case, zippered opening, locking opening, etc. for carrying desired items. In one embodiment, the utility bag 140 may be made of leather, canvas, synthetic leather, suede, synthetic suede, plastic, hardened plastic, nylon, metal, etc.

In one embodiment, the lower portion 130 includes a gripping portion that may include a padded or comfortable material (e.g., rubber, silicone, leather with padding, etc. In one embodiment, the lighting device 110 includes a switching portion. In one embodiment, the lighting elements 111 (e.g., LEDs) may comprise one or more colors (e.g., white, red, green, blue, etc.).

In one embodiment, the utility bag 140 includes rolling elements 141, such as wheels, rollers, etc. In one embodiment, the utility bag 140 includes two or more wheels 141 located on the bottom of the utility bag 140. In one embodiment, the utility bag 140 includes two wheels 141 on the rear bottom, and two stops or raised portions 142 on the front bottom. In one embodiment, the utility bag 140 may have two wheels 141 in replacement of the two stops or raised portions 142.

Figure 2:
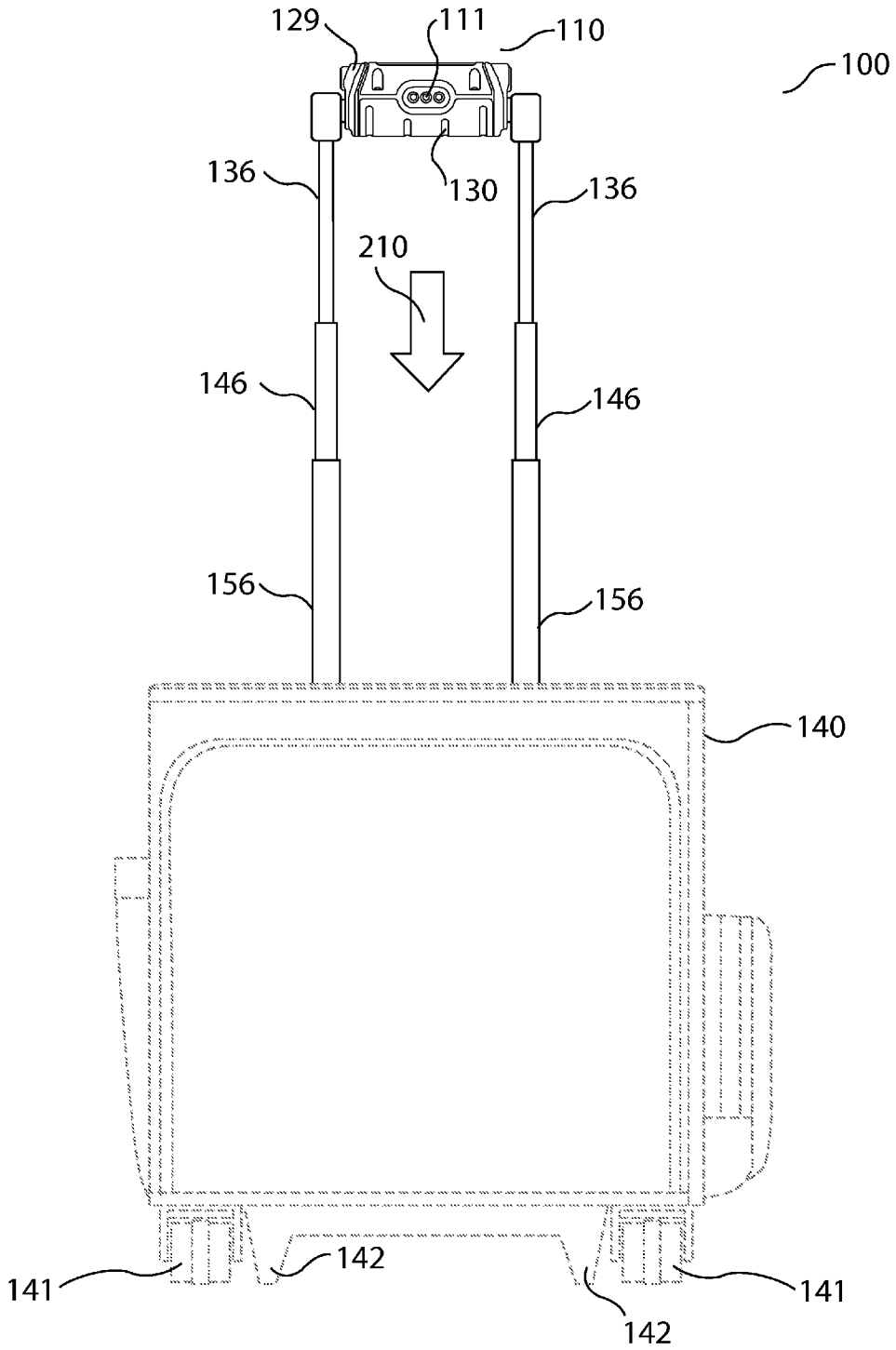
FIG. 2 illustrates a front view of a lighting device coupled to an extendible handle showing an example utility bag shown moving to a closed handle position according to one embodiment.

FIG. 2 illustrates a front view of a light source 110 coupled to the extendible handle 145 showing an example utility bag 140 shown moving to a closed handle position in the direction of the arrow 210 according to one embodiment.

Figure 3:
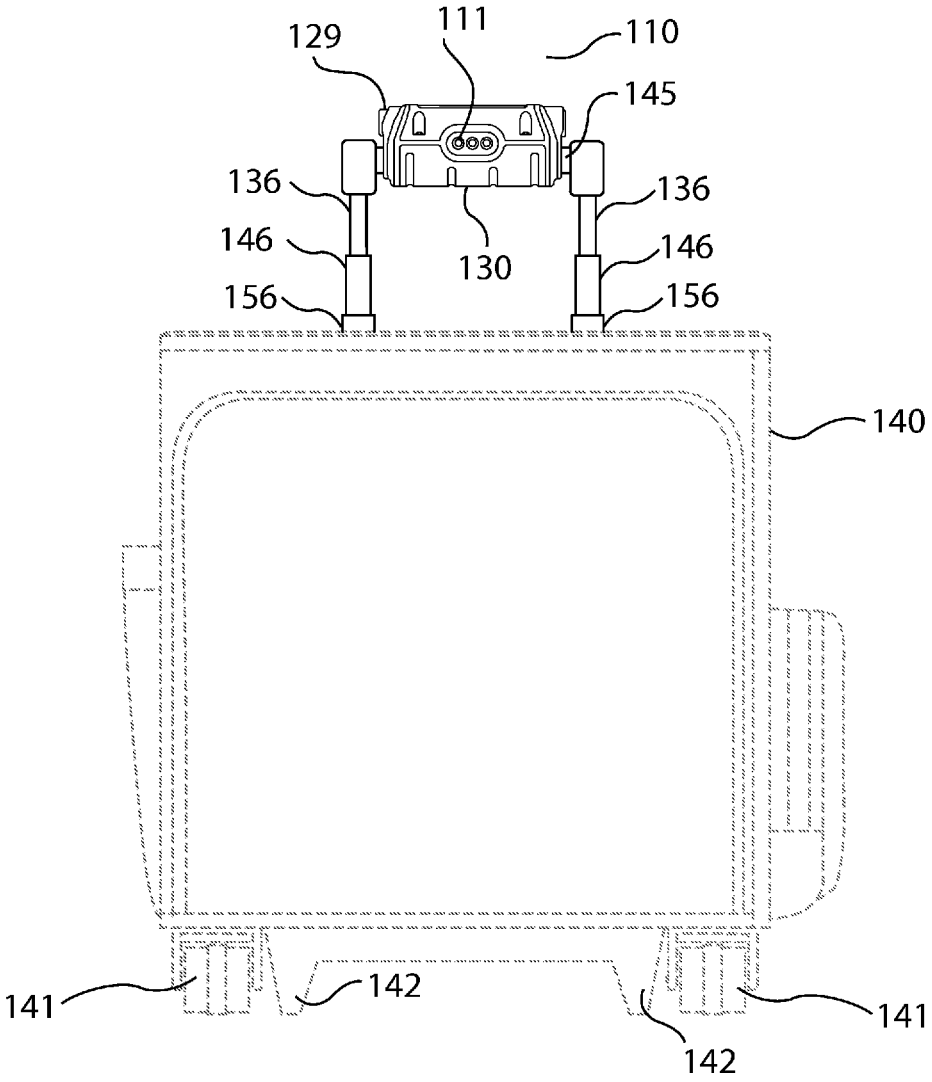
FIG. 3 illustrates a front view of a lighting device coupled to an extendible handle showing an example utility bag shown moved to a closed handle position according to one embodiment.

FIG. 3 illustrates a front view of a light source 110 coupled to an extendible handle 145 showing an example utility bag 140 shown moved to a closed handle position. In one embodiment, the light source 110 is the handle or acts as the handle portion of a utility bag 140. In one embodiment, the lighting device 110 includes a cushion or rubber gripping portion on or part of the upper portion 129 and lower portion 130.

Figure 4:
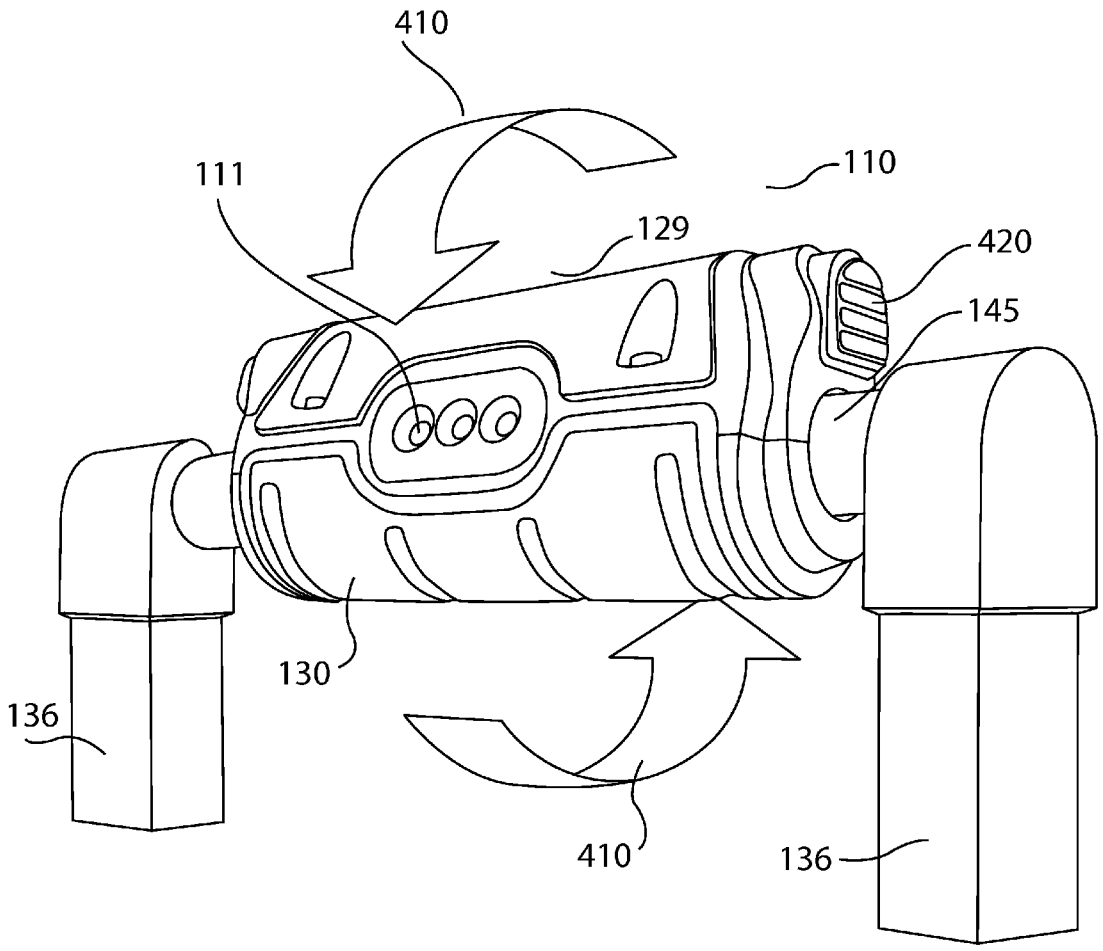
FIG. 4 illustrates a view of a lighting device coupled to an extendible handle showing rotational mobility according to one embodiment.

FIG. 4 illustrates a view of a lighting device 110 coupled to an extendible handle 145 showing rotational mobility in the direction of the arrows 410 according to one embodiment. In one embodiment, the lighting device 110 shows a position for a lighted state in the direction of the arrows 410 according to one embodiment. In this example embodiment, the lighting element 110 provides light upon turning the light element 111 to an ON state with a switch 420 (e.g., a pushbutton switch, a slide-switch, etc.), or upon rotation of the handle if using a rotational switch included internal within the upper portion 129 and the lower portion 130.

In one embodiment, the lighting source housing including an upper portion 129 and lower portion 130 may rotate clockwise or counter-clockwise to provide light in the direction of the sides of the utility bag 140. In one example, the lighting source housing is attached to the handle 145 of the utility bag 140 via a compression means for attaching. In one embodiment, the anchor devices rotate with the lighting source housing. In other embodiments, the anchor devices are stationary and anchor the lighting source housing to the handle 145 of the utility bag 140, where the lighting source housing rotates around the handle 145.

In one example embodiment an interior sleeve (not shown) is used for providing the rotation of the lighting device 110. In this example, a cam or ratchet type of movement provides for the lighting device 110 to be rotated in fixed or predetermined positions, such as 90°, 180°, etc. In another example, the lighting device 110 may be rotated freely and locks or remains in a desired position based on friction between the sleeve and the lighting device 110.

In one embodiment, the lighting device 110 may rotate between 0°-180°. In other embodiments of the invention, the lighting source may rotate 360°. The rotation functionality of the lighting device 110 provides precision targeted lighting in many directions, including within the utility bag 140, the sides of the utility bag 140, and away from the utility bag 140, which provides precision lighting to areas external to the utility bag 140 (e.g., working areas, front/rear pathways, etc.).

Figure 5:
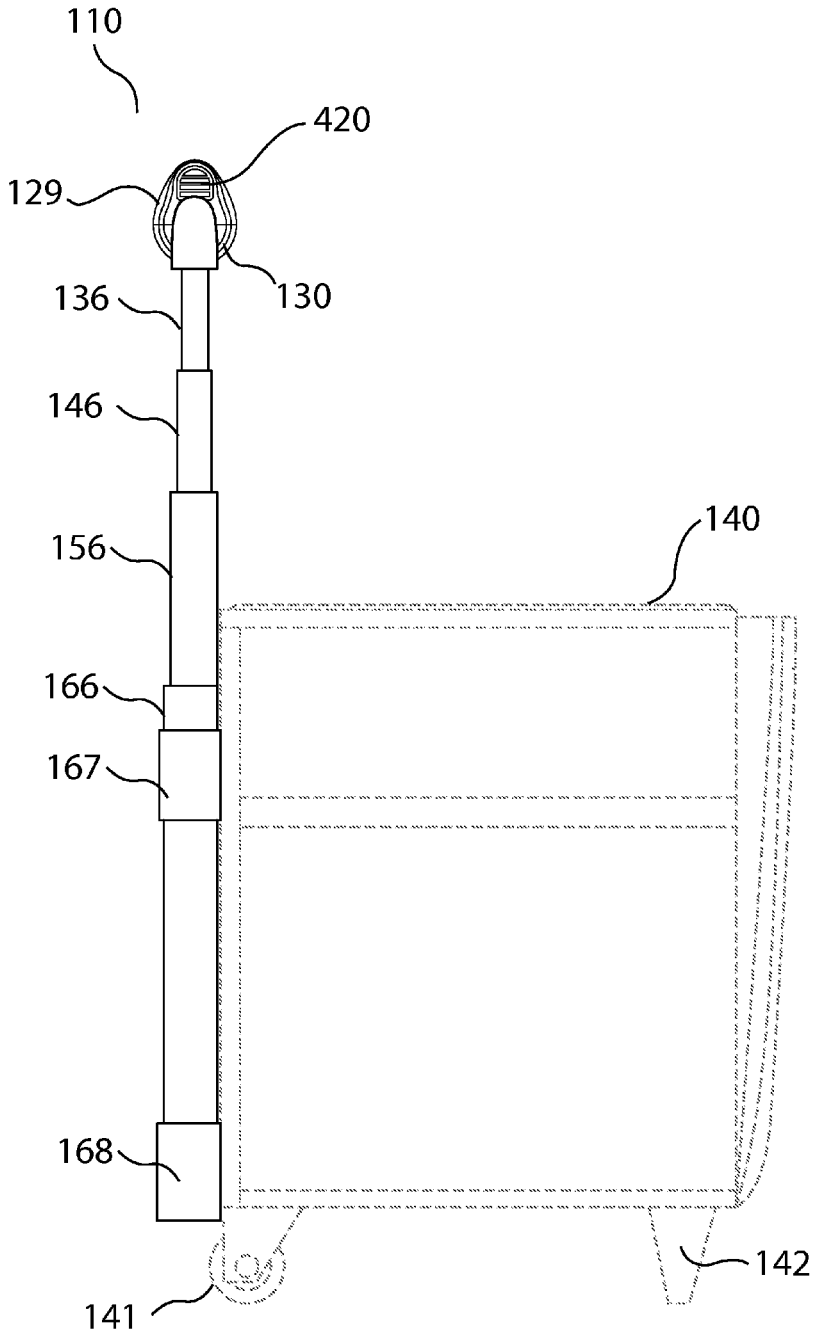
FIG. 5 illustrates a right-side view of a lighting device coupled to an extendible handle attached to an example utility bag according to one embodiment.

FIG. 5 illustrates a right-side view of a lighting device 110 coupled to an extendible handle 145 attached to an example utility bag 140 according to one embodiment. In one example embodiment, the lighting source housing may rotate in increments via a ratcheting mechanism that provides increments, such as in 15°, 30°, 45°, 90°, etc. increments of rotation, where the lighting source housing is ratcheted to a releasable locked position in each increment.

Figure 6:
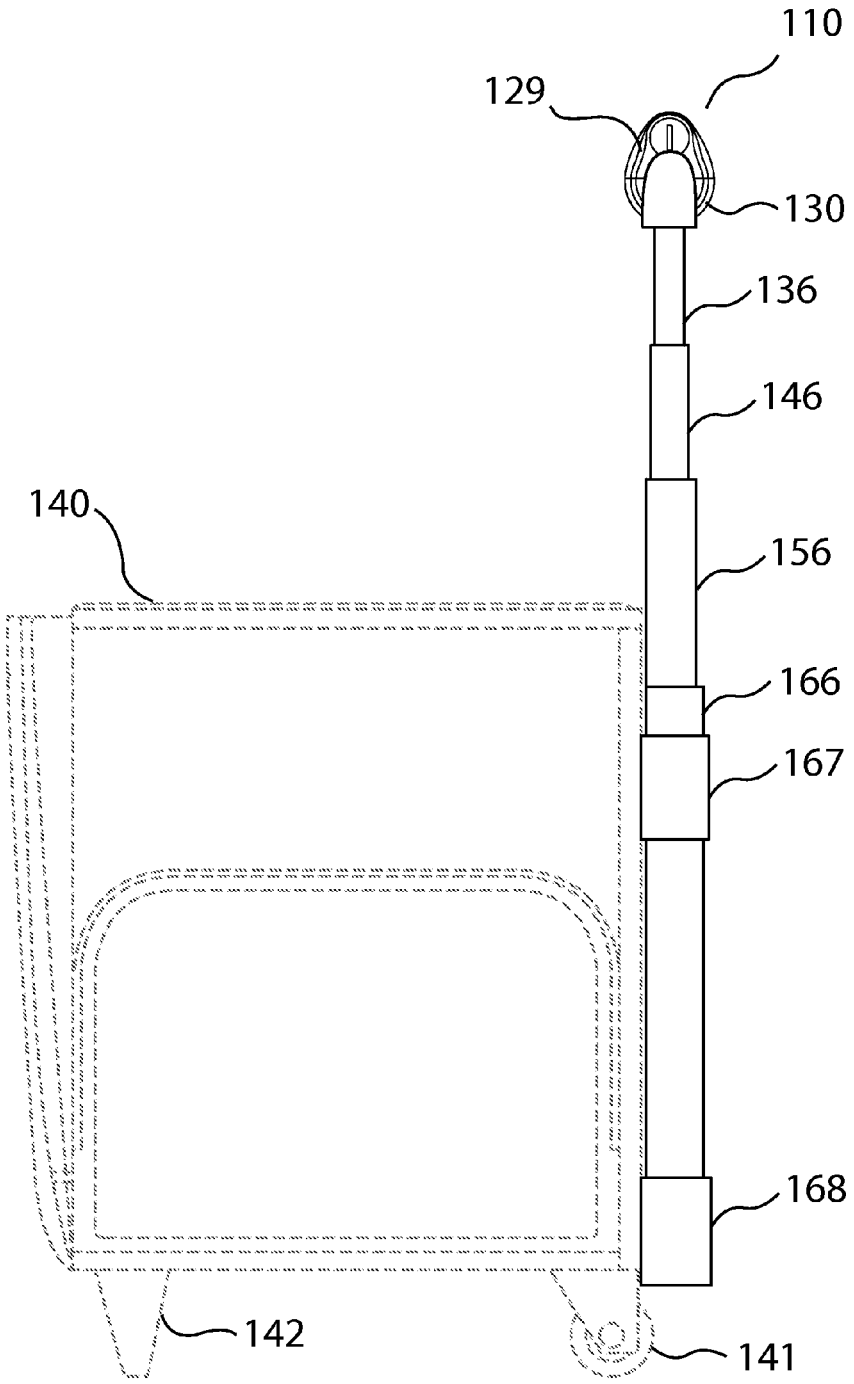
FIG. 6 illustrates a left-side view of a lighting device coupled to an extendible handle attached to an example utility bag according to one embodiment.

FIG. 6 illustrates a left-side view of a lighting device 110 coupled to an extendible handle 145 attached to an example utility bag 140 according to one embodiment. In one embodiment of the invention, the lighting source housing is permanently fixed to the handle 145 of the utility bag 140. In other embodiments of the invention, the lighting source housing may be removably coupled to the handle 145. In one embodiment, the lighting device 110 is integrated with the handle 145.

Figure 7:
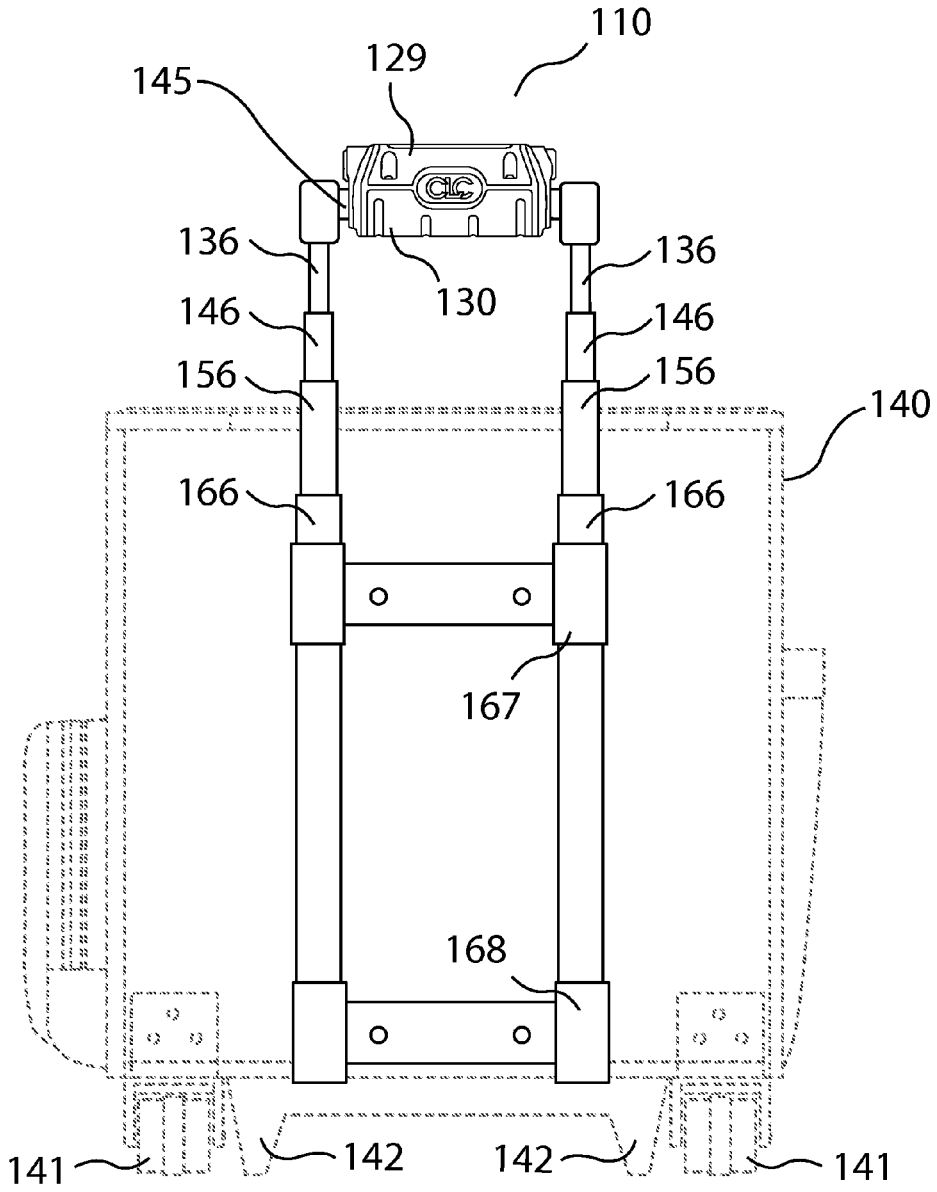
FIG. 7 illustrates a rear view of a lighting device coupled to an extendible handle attached to an example utility bag according to one embodiment.

FIG. 7 illustrates a rear view of a lighting device 110 coupled to an extendible handle 145 attached to an example utility bag 140 according to one embodiment. In one embodiment, a pair of base arms 166 are coupled to the telescoping arms 156 and attaching elements 167 and 168. In one embodiment, the example utility bag 140 is coupled to the attaching elements 167 and 168. In one embodiment, the attaching elements 167 and 168 may comprises brackets or other similar types of devices that may be attached to the example utility bag 140 via known means, such as fasteners (e.g., nuts and bolts, screws, rivets, etc.), permanent welding, etc.

In one embodiment, the attaching elements 167 and 168 may be internal to the example utility bag 140 (e.g., covered, built-in, within a formed pocket, etc.). In one embodiment, the attachment elements 167 and 168 are attached to another pair of attachment elements 167 and 168 internal to the example utility bag. In another embodiment, the attachment elements 167 and 168 are attached to an anchor plate or similar device for fixing the arms 166 to the example utility bag 140.

Figure 8:
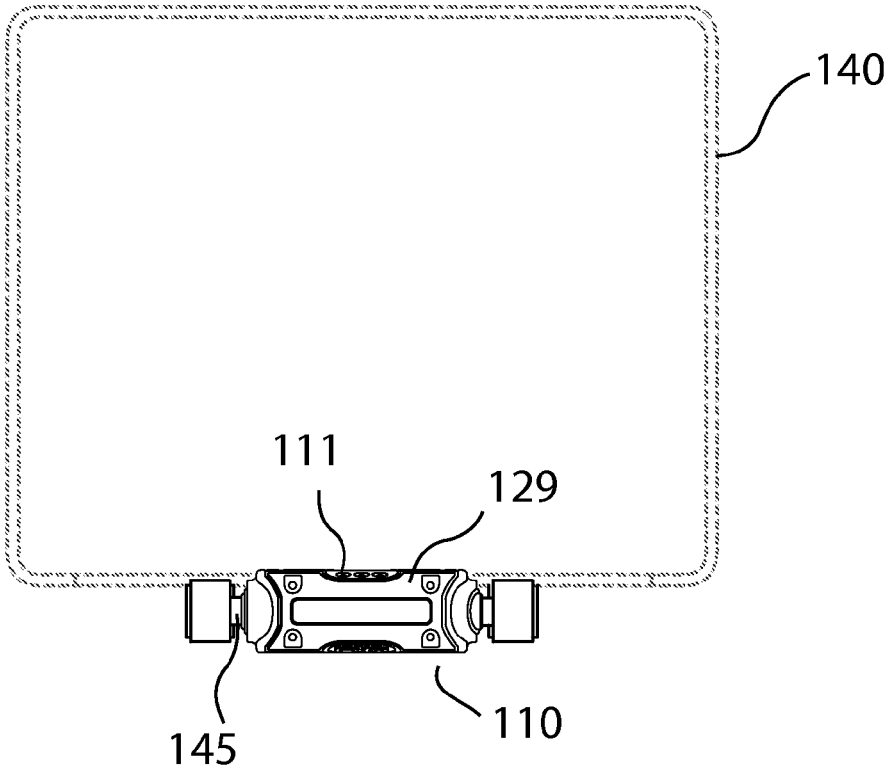
FIG. 8 illustrates a top view of a lighting device coupled to an extendible handle attached to an example utility bag according to one embodiment.

FIG. 8 illustrates a top view of a lighting device 110 coupled to an extendible handle 145 attached to an example utility bag 140 according to one embodiment. In one embodiment the lighting device 110 includes a circuit according to one embodiment. In one embodiment, the circuit for the lighting device 110 includes the lighting element 111, a switch, a power source and an optional sensor. In one example, the switch may comprise a slide switch, a push button switch, etc. In one example, the switch 420 is disposed on the lighting source housing on either the upper portion 129 or lower portion 130 (e.g., on the outer top portion, a side portion, an inner portion, etc.).

In one embodiment of the invention, the switch may comprise a user lighting selection functionality for controlling amount the lighting element 111 by means of a controller circuit. In one example, the switch and controller circuit may be user selectable to light only a portion of LEDs of the lighting element 111 (e.g., one, two, three, all, etc.). In another example, the switch and controller circuit may be user selectable to select a particular color of LEDs of the lighting element 111 (e.g., white, red, green, yellow, infrared, etc.). In yet another example, the switch and controller circuit may be user selectable to select solid or blinking LEDs of the lighting element 111.

In one example, the sensor may comprise a position determining sensor, a motion sensor, a light sensor, or any combination of various sensors to provide control of the switch. In one example, upon employing a position determining sensor as sensor, rotating the lighting source housing to an ON state (e.g., a positioning away the lighting element 111 from facing up) closes the switch, which provides voltage to the lighting element 111, and moving the lighting source housing back to the facing upward position opens the switch cutting off voltage to the lighting element 111.

In one example, upon employing a motion sensor as sensor, a timer regulates the time that the switch is closed based on sensing motion within a predetermined distance from this sensor disposed on the lighting source housing. In one embodiment of the invention, the predetermined motion sensing distance is adjustable by a user from 1 ft.-15 ft. In another embodiment of the invention, the predetermined motion sensing distance is preset between distances of 1 ft-3 ft.

In one example, the motion sensor may be turned on or off so that the switch may be manually set on/off. In one embodiment, the timer may be user adjustable or preset to a particular amount of time. In one example, the timer may be adjusted from 5 seconds to 15 minutes. In another example, the timer is preset between 30 seconds and one minute. The use of the motion sensor provides lighting in the set direction of the lighting source housing by sensing motion without a user having to manually press/slide the switch.

In one example, upon employing a light sensor as the sensor, when the switch is placed in an ON position, the sensor will not close the circuit unless the sensor senses that not enough light is within the proximity of the light sensor (i.e., the area is dark enough to necessitate lighting the area). In one example, the light sensor may be positioned on the sides, exterior or interior portions of the lighting source housing. In one example, employing the light sensor provides energy saving when lighting the light source 110 is not necessary based on available ambient light. In one example, the light sensor may be manually overridden.

In one example, the sensor may include any combination of sensors, such as motion and light sensors, position and light sensors, etc.

In one embodiment, the power source comprises rechargeable or non-rechargeable batteries selected based on the number of LEDs and/or voltage required to power the lighting element 111. In one example, a solar charging circuit is employed to store energy in a rechargeable battery of power source. In one example, the solar charging circuit may be disposed on the outer portion of the lighting source housing. In another example, an adapter or plug in socket may be employed with the lighting device 110 to connect to an external power source, such as a battery pack from an electric tool (e.g., electric drill, hammer, screwdriver, etc.), separate additional battery pack, an AC/DC power supply, USB, etc.

In one embodiment, the switch 420 may comprise a user lighting selection functionality for controlling a desired light intensity from the lighting element 111 by means of a controller circuit. In one example, the switch 420 and controller circuit may be user selectable to light only a portion of LEDs of the lighting element (e.g., one, two, three, all, etc.).

In another example, the switch 420 and controller circuit may be user selectable to select a particular color of LEDs of the lighting element (e.g., white, red, green, blue, yellow, etc.). In yet another example, the switch 420 and controller circuit may be user selectable to select solid or blinking LEDs of the lighting element.

In one embodiment, the lighting device 110 may vary in size. In one example, width of the lighting device 110 may range in width from 1 inch-3 inches, preferably between 1.5 inches-2.5 inches; and the length of the lighting device 110 may range from 5 inches-12 inches, preferably between 6 inches-8 inches. It should be noted that the lighting device 110 may be customized and fit according to necessity and desire of the user, and based on the diameter of the handle 145 of the utility bag 140 used.

In other examples, other types of light sources may be employed with lighting element 111, such as Electroluminescent (EL) light sources, etc. In one embodiment of the invention, the lighting device 110 includes glow-in-the-dark material.

In one example, the lighting device 110 may be made of one or more of: reinforced polypropylene, polypropylene, high-density polyethylene, nylon material, hardened plastic, polymer, rubber, composite material, metal or metal alloy, etc., or other similar or equivalent materials.

In one example, the removed lighting source housing 110 may be attached to other extendible handles, such as handles of a tool, etc. to provide user directed targeted lighting.

In one embodiment of the invention, the lighting device 110 may be provided as a kit to be attached to an existing extendible handle of a device, tool or a handle 145 of a utility bag 140. In one example, the lighting device 110 is attached around the handle 145 as the anchor devices comprise at least two portions that attach to one another to couple around the handle 145. In one example, the anchor devices are attached to the handle 145 via compression means (e.g., clamping, friction tightening, etc.), or other similar means for attaching. In another example, the handle 145 with the lighting device 110 are integrated and replace a typical handle for a rolling bag.

With the light source 110 providing lighting in the desired rotation direction, a user may light a surrounding area without having to hold a light source, such as a flashlight, when natural light or other light sources are not available.

In the description above, numerous specific details are set forth. However, it is understood that embodiments of the invention may be practiced without these specific details. For example, well-known equivalent components and elements may be substituted in place of those described herein, and similarly, well-known equivalent techniques may be substituted in place of the particular techniques disclosed. In other instances, well-known structures and techniques have not been shown in detail to avoid obscuring the understanding of this description.

In one example, upon employing a motion sensor, a timer regulates the time that the lighting switch is closed based on sensing motion within a predetermined distance from this sensor disposed on the lighting source 125. In one embodiment, the predetermined motion sensing distance is adjustable by a user from 1 ft.-15 ft. In another embodiment, the predetermined motion sensing distance is preset between distances of 1 ft-3 ft. In one example, the motion sensor may be turned on or off so that the lighting switch may be manually set on/off. In one embodiment, the timer may be user adjustable or preset to a particular amount of time. In one example, the timer may be adjusted from 5 seconds to 15 minutes. In another example, the timer is preset between 30 seconds and one minute. The use of the motion sensor provides lighting in the set direction of the lighting source 125 by sensing motion without a user having to manually activate the lighting switch.

FIG. 5 illustrates a right-side view of a lighting device 110 coupled to an extendible handle 145 attached to an example utility bag 140 according to one embodiment. In one example, upon employing a light sensor, when the lighting switch is placed in an ON position, the sensor will not close the circuit unless the sensor senses that not enough light is within the proximity of the light sensor (i.e., the area is dark enough to necessitate lighting the area).

FIG. 6 illustrates a left-side view of a lighting device 110 coupled to an extendible handle 145 attached to an example utility bag 140 according to one embodiment. In one example, the light sensor may be positioned as desired. In one example, employing the light sensor provides energy saving when lighting the lighting source is not necessary based on available ambient light. In one example, the light sensor may be manually overridden.

In one example, the sensor may include any combination of sensors, such as motion and light sensors, position and light sensors, etc.

In one embodiment, the power source comprises rechargeable or non-rechargeable batteries selected based on the number of LEDs and/or voltage required to power the lighting element. In one example, a solar charging circuit is employed to store energy in a rechargeable battery or power source. In one example, the solar charging circuit may be disposed as desired. In another example, an adapter or plug in socket may be employed with the lighting source 125 to connect to an external power source, such as a battery pack from an electric tool (e.g., electric drill, hammer, screwdriver, etc.), separate additional battery pack, an AC/DC power supply, a USB connection, a computer, etc.

In other examples, other types of light sources may be employed with lighting element, such as Electroluminescent (EL) light sources, etc. In one embodiment, the lighting source includes glow-in-the-dark material.

FIG. 8 illustrates a top view of a lighting device 110 coupled to an extendible handle 145 attached to an example utility bag 140 according to one embodiment. In one example, the lighting device 110 body may be made of one or more of: ABS, reinforced polypropylene, polypropylene, high-density polyethylene, nylon material, hardened plastic, polymer, rubber, composite material, metal or metal alloy, etc., or other similar or equivalent materials.

As is known to those skilled in the art, the aforementioned example architectures described above, according to one or more embodiments, may be implemented in many ways, such as program instructions for execution by a processor, as software modules, microcode, as computer program product on computer readable media, as logic circuits, as application specific integrated circuits, as firmware, as consumer electronic devices, etc., in wireless devices, in wireless transmitters, receivers, transceivers in wireless networks, etc. Further, one or more embodiments may take the form of an entirely hardware embodiment, an entirely software embodiment or an embodiment containing both hardware and software elements.

In the description above, numerous specific details are set forth. However, it is understood that embodiments may be practiced without these specific details. For example, well-known equivalent components and elements may be substituted in place of those described herein, and similarly, well-known equivalent techniques may be substituted in place of the particular techniques disclosed. In other instances, well-known structures and techniques have not been shown in detail to avoid obscuring the understanding of this description.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. An apparatus comprising:

an extendible handle including a lighting device that is configured to rotate, wherein the extendible handle is coupled to two or more pairs of connected telescoping arms;

a pair of base arms coupled to the two or more pairs of connected telescoping arms; and a storage container including one or more rolling elements, wherein the storage container is coupled to the pair of base arms, wherein the lighting device comprises:

at least one light source;

a lighting source housing coupled to the light source, wherein the lighting source housing includes a separate upper portion and a separate lower portion that couple to each other forming an opening for coupling around the extendible handle, and the separate lower portion includes a hand grip portion;

a first anchor device coupled to a first end of the lighting source housing; and a second anchor device coupled to a second end of the lighting source housing, wherein:

the first anchor device and the second anchor device are each coupled to a sleeve that is coupled to the extendible handle;

the lighting source housing rotates around the extendible handle for multi-positional lighting, the at least one light source comprises a plurality of light emitting diodes, the first anchor device and the second anchor device are fixed to the sleeve via compression for friction.

2. The apparatus of claim 1, further comprising a switch device coupled to the at least one light source.

3. The apparatus of claim 2, wherein the lighting source housing is configured to rotate between 0 to 180 degrees.

4. The apparatus of claim 1, wherein the lighting source housing is permanently affixed to the handle.

5. The apparatus of claim 1, wherein the separate upper portion and the separate lower portion fasten together, and the hand grip portion includes a cushion or rubber portion.

6. The apparatus of claim 5, wherein the storage container comprises one of: a sporting bag, a fishing bag, a luggage container, a document holder, a duffle bag, a tool bag, and a camping bag.

7. The apparatus of claim 1, wherein the lighting device is one of integrated with the extendible handle or attached to the extendible handle.

8. A rolling storage system comprising:

an extendible handle coupled to two or more pairs of telescoping arms;

a lighting device that is configured to rotate, the lighting device being coupled around the extendible handle;

a pair of base arms coupled to the two or more connected telescoping arms and one or more attaching elements; and a bag coupled to the one or more attaching elements, the bag including one or more rolling elements, wherein the lighting device comprises:

at least one light source;

a lighting source housing coupled to the light source, wherein the lighting source housing includes a separate upper portion and a separate lower portion that couple to each other forming an opening for coupling around the extendible handle, and the separate lower portion includes a hand grip portion;

a first anchor device coupled to a first end of the lighting source housing; and a second anchor device coupled to a second end of the lighting source housing, wherein:

the first anchor device and the second anchor device are each coupled to a sleeve that is coupled to the extendible handle;

the lighting source housing rotates around the extendible handle for multi-positional lighting, the at least one light source comprises a plurality of light emitting diodes, the first anchor device and the second anchor device are fixed to the sleeve via compression for friction.

9. The system of claim 8, wherein the lighting device comprises:

a switch device coupled to the at least one light source.

10. The system of claim 9, wherein the lighting source housing is configured to rotate between 0 to 180 degrees.

11. The system of claim 10, wherein the bag comprises one of:

a sporting bag, a fishing bag, luggage, a document bag, a duffle bag, a camping bag, and a tool bag.

12. An apparatus comprising:

an extendible handle coupled to two or more pairs of telescoping arms;

a lighting device that is configured to rotate, the lighting device being coupled around the extendible handle; and a pair of base arms coupled to the two or more connected telescoping arms and one or more attaching elements that are configured for coupling to a utility bag, wherein the lighting device comprises:

at least one light source; and a lighting source housing coupled to the light source, wherein the lighting source housing includes a separate upper portion and a separate lower portion that couple to each other forming an opening for coupling around the extendible handle, and the separate lower portion includes a hand grip portion;

a first anchor device coupled to a first end of the lighting source housing; and a second anchor device coupled to a second end of the lighting source housing, wherein:

the first anchor device and the second anchor device are each coupled to a sleeve that is coupled to the extendible handle;

the lighting source housing rotates around the extendible handle for multi-positional lighting, the at least one light source comprises a plurality of light emitting diodes, the first anchor device and the second anchor device are fixed to the sleeve via compression for friction.

13. The apparatus of claim 12, wherein the lighting device comprises:

a switch device coupled to the at least one light source; and wherein the lighting source housing is configured to rotate-between 0 to 180 degrees, the separate upper portion and the separate lower portion fasten together, and the hand grip portion includes a cushion or rubber portion.

* * * * *